US008920260B1

(12) United States Patent
Azmudeh

(10) Patent No.: US 8,920,260 B1
(45) Date of Patent: Dec. 30, 2014

(54) GOLF CLUB PUTTER WITH ROLLER PUTTING HEAD

(71) Applicant: Manucher Azmudeh, Palm Beach, FL (US)

(72) Inventor: Manucher Azmudeh, Palm Beach, FL (US)

( * ) Notice: Subject to any disclaimer, the term of this patent is extended or adjusted under 35 U.S.C. 154(b) by 0 days.

(21) Appl. No.: 14/278,174

(22) Filed: May 15, 2014

(51) Int. Cl.
*A63B 53/04* (2006.01)
*A63B 53/02* (2006.01)

(52) U.S. Cl.
USPC ..... 473/329; 473/340; 473/307

(58) Field of Classification Search
CPC . A63B 53/0487; A63B 53/065; A63B 53/007
USPC ..... 473/293–294, 313, 340–341, 329, 307
See application file for complete search history.

(56) References Cited

U.S. PATENT DOCUMENTS

| | | | | |
|---|---|---|---|---|
| 4,872,684 | A * | 10/1989 | Dippel | 473/253 |
| 5,433,441 | A * | 7/1995 | Olsen et al. | 473/328 |
| 5,577,965 | A * | 11/1996 | Burgess | 473/230 |
| 5,597,362 | A * | 1/1997 | Lee et al. | 473/244 |
| 6,017,281 | A * | 1/2000 | Behling | 473/330 |
| 6,066,053 | A * | 5/2000 | Sehemberger | 473/230 |
| 6,554,721 | B1 * | 4/2003 | Woodward et al. | 473/331 |
| 6,767,293 | B2 * | 7/2004 | Pechter et al. | 473/313 |
| 2004/0147336 | A1 * | 7/2004 | Cosmo | 473/293 |
| 2004/0259654 | A1 * | 12/2004 | Failla et al. | 473/230 |

FOREIGN PATENT DOCUMENTS

| | | | |
|---|---|---|---|
| CA | 2521955 | * | 4/2007 |

* cited by examiner

*Primary Examiner* — Stephen L. Blau
(74) *Attorney, Agent, or Firm* — Gold & Rizvi, P.A.; Glenn E. Gold

(57) ABSTRACT

A golf club putting head includes a flexible cylindrical roller body having a striking face defined thereon and thereabout. The roller body has a central bore extending therethrough from end to end thereof and configured to mount the body over an axle on a lower end of a putter shaft such that the body can undergo rotation about and relative to the axle. The striking face on the body is yieldably conformable to the shape of a golf ball upon impacting the ball and is formed by an annular bed of multiple flexible projections formed on and about the body. The putting head also includes a pommel fitted on an outer end of the axle and configured for adjusting the rollability of the roller body on the axle so as to enable a player to hit the ball with an impact that will cause it to roll towards the hole.

18 Claims, 4 Drawing Sheets

GOLF CLUB PUTTER WITH ROLLER PUTTING HEAD

FIELD OF THE INVENTION

The present invention relates to golf clubs in general, and more particularly is concerned with a golf club putter with a roller putting head that minimizes adverse effects resulting from imperfect angles of impact of the putting head with a golf ball.

BACKGROUND OF THE INVENTION

It is a well known fact in the game of golf that a golfer's short game, particularly the putting part, plays a major part in a golfer winning or losing. Putting in particular is usually the least reliable or consistent part of the golfer's game. In putting the golf ball toward the hole, the desired technique is not to hit the golf ball as a hard impact by the putting head that would launch the golf ball toward the hole and cause it to bounce. Instead, the desired technique is to try to hit the golf ball with a more gentle impact by the putting head that will more likely result in the golf ball rolling towards the hole.

However, it is exceedingly difficult to putt the golf ball with a sufficiently gentle impact using the present day golf club putter that has a conventional fixed head with a hard striking surface (that is, harder than, or relative to, the surface of the golf ball). The fact that numerous putter designs and putting techniques have been proposed and developed in the past toward achieving this capability is illustrative of the considerable efforts that have been made to enable the golfer to obtain delicate control over his or her putting. It appears that as long as putters continue to employ a fixed head with a hard striking surface, the problem of finding a way to gain such delicate control will remain unresolved.

Accordingly, there remains a need in the art for an innovation that will enable the golfer to gain better control of the putting part of the short game.

SUMMARY OF THE INVENTION

The present invention overcomes the deficiencies of the known art and the problems that remain unsolved by providing a golf club putter with a roller putting head having a striking face formed on and about the roller putting head that is soft (that is, softer than, or relative to, the surface of the golf ball) and thus conformable to the shape of the golf ball upon impacting the ball. When using a putter with a conventional hard striking surface head the angle of impact is frequently not normal with the desired path to the hole. By using the roller putting head of the present invention, its soft conformable striking face is more likely to achieve a sufficiently gentle impact on the golf ball that will minimize adverse effects resulting from imperfections in the angle of impact with the golf ball and more reliably and consistently result in the golf ball rolling towards the hole along the desired path.

In one aspect of the present invention, a golf club putting head includes:

- a roller body of a cylindrical configuration; and
- a striking face defined on and about the roller body being yieldably conformable to the shape of a golf ball upon impacting the golf ball.

In another aspect of the present invention, the striking face on the roller body is formed by an annular bed of multiple flexible projections formed on and about the roller body and protruding from the roller body over a uniform distance and radially outward from a central axis of the roller body.

In another aspect of the present invention, a golf club putting head includes:

- a roller body of a cylindrical configuration, the roller body having a pair of opposite ends and a central bore of a cylindrical configuration formed in and extending through the roller body from one to the other of the opposite ends thereof and being adapted to mount the roller body over an axle on a lower end portion of a golf club putter shaft such that the roller body can undergo rotation about and relative to the axle;
- a striking face defined on and about the roller body and being yieldably conformable to the shape of a golf ball upon impacting the golf ball, the striking face being formed by an annular bed of multiple flexible projections formed on and about the roller body; and
- a pommel fittable on an outer end of the putter shaft axle and being configured for adjusting the rollability of the roller body on the axle so as to enable a player to hit the golf ball with an impact that will result in the golf ball rolling towards a hole.

In another aspect of the present invention, a pair of end discs made of a rigid material, having central apertures and being respectively adhered to the opposite ends of the roller body are disposed over the axle when the roller body is mounted over the axle.

In another aspect of the present invention, a golf club putter includes:

- an elongated shaft having opposite upper and lower end portions;
- a handgrip fitted about the upper end portion of the elongated shaft for gripping by a player's hand in order to stroke the putter to putt a golf ball;
- an axle having a pair of opposite ends, the axle at one of the ends being attached to and extending outwardly from the lower end portion of the elongated shaft; and
- a putting head having
  - a roller body of a cylindrical configuration, the roller body having a pair of opposite ends and a central bore of a cylindrical configuration formed in and extending through the roller body from one to the other of the opposite ends thereof and mounting the roller body over the axle such that the roller putting head can undergo rotation about and relative to the axle, and
  - a striking face defined on and about the roller body being yieldably conformable to the shape of the golf ball upon impacting the ball, and
  - a pommel fitted on an outer end of the axle of the elongated shaft and being configured for adjusting the rollability of the roller body on the axle so as to enable the player to hit the golf ball with an impact that will result in the golf ball rolling towards a hole.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
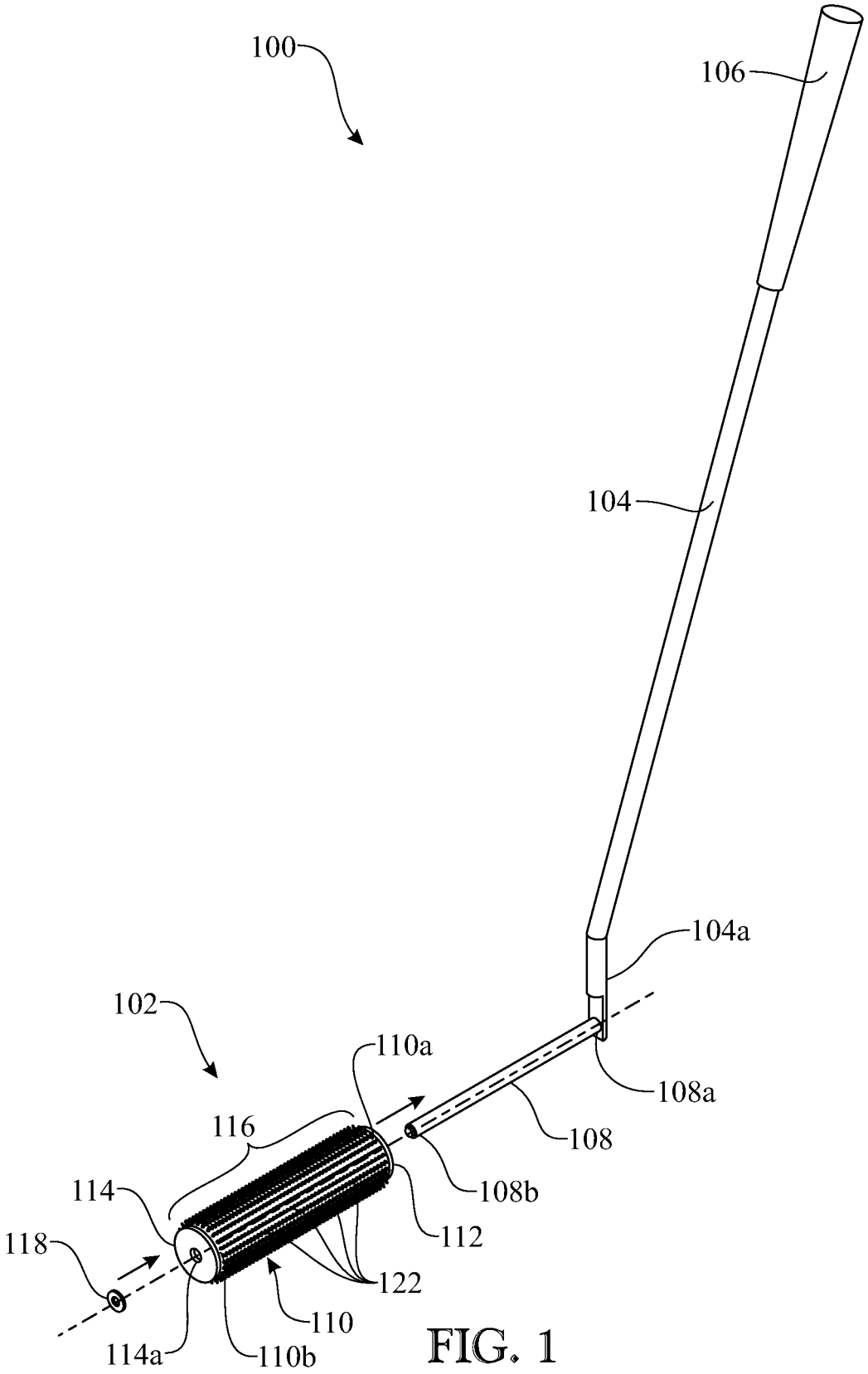
FIG. 1 presents an isometric, exploded view of an exemplary embodiment of a golf club putter with a roller putting head in accordance with the present invention.
Figure 2:
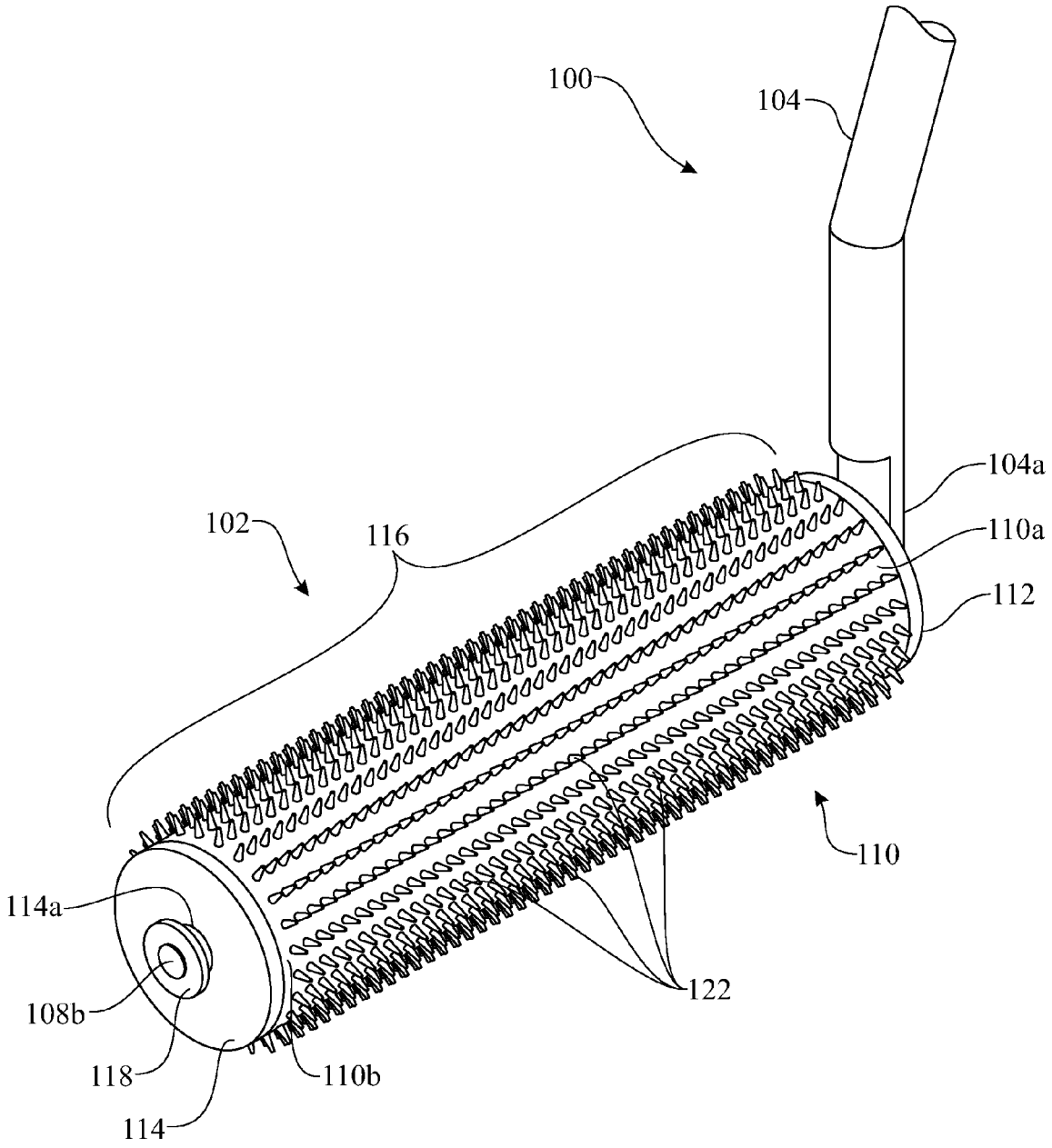
FIG. 2 presents an enlarged view of the roller putting head originally introduced in FIG. 1, now shown assembled on an axle of the putter.
Figure 3:
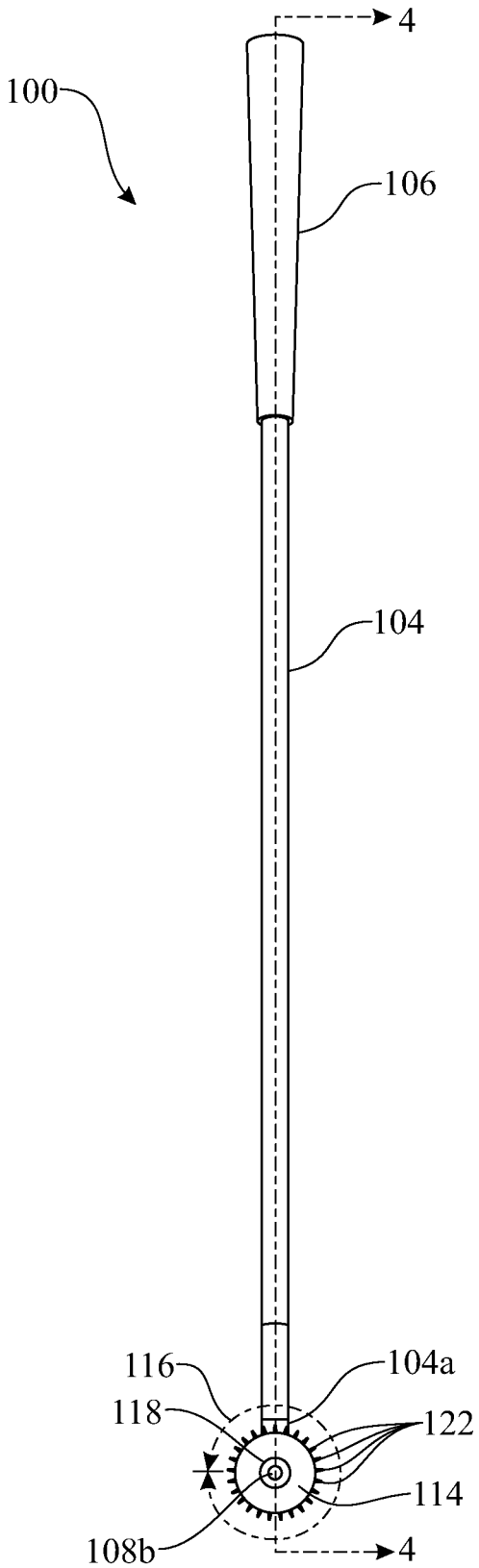
FIG. 3 presents an assembled front elevational view of the golf club putter with the roller putting head originally introduced in FIG. 1.
Figure 4:
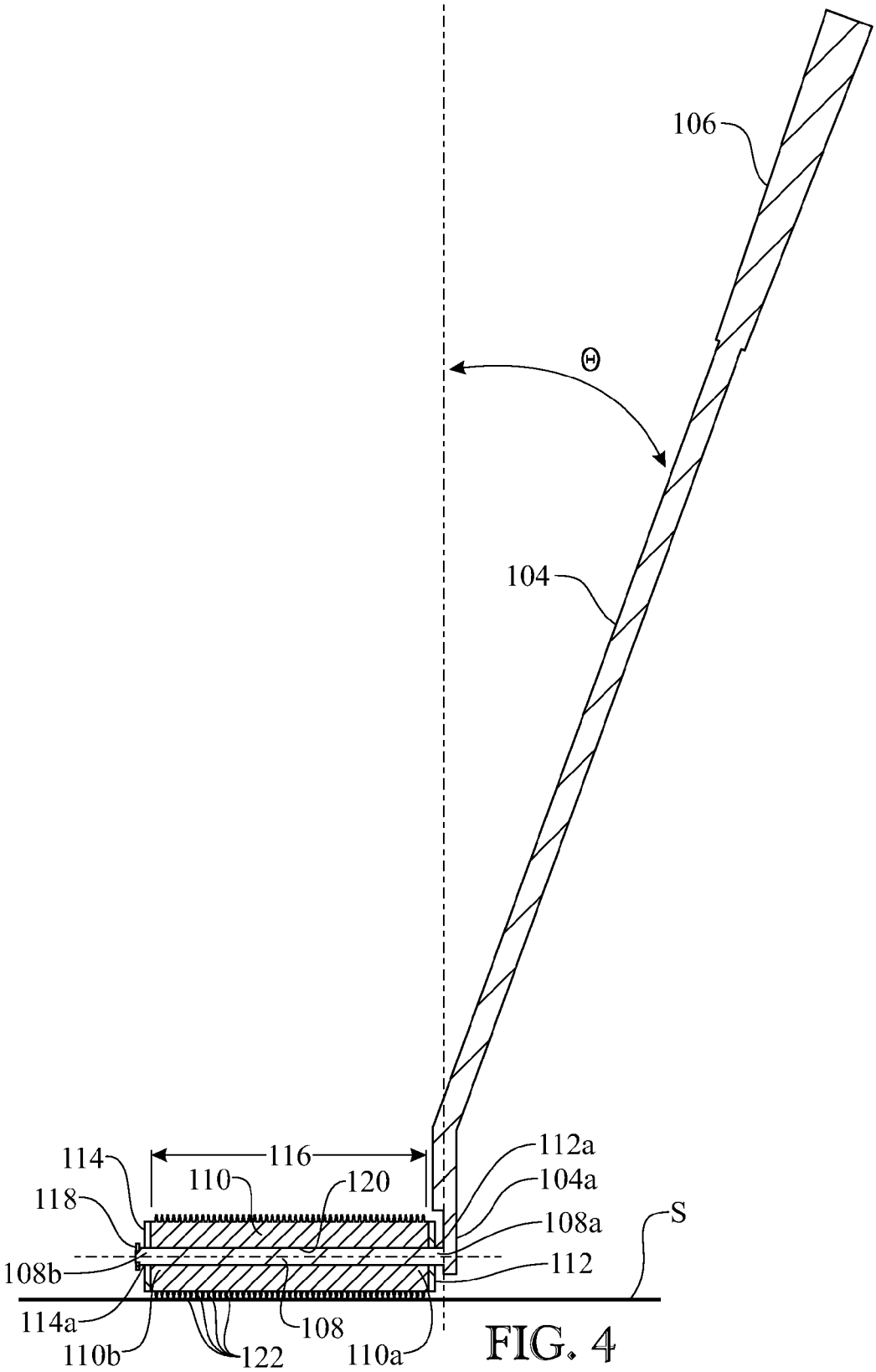
FIG. 4 presents a longitudinal sectional view of the golf club putter with the roller putting head taken along line 4-4 in FIG. 3.

Referring now to FIGS. 1, 3 and 4, there is shown an exemplary embodiment of a golf club putter, generally designated 100, employing a roller putting head 102 in accordance with the present invention. The roller putting head 102 minimizes adverse effects resulting from imperfect angles of impact of the putting head with a golf ball. In addition to the roller putting head 102, the putter 100 includes an elongated shaft 104 and a handgrip 106.

More particularly, the elongated shaft 104 of the putter 100 is conventionally made in either a tubular or solid configuration and typically from a suitable metal material. The handgrip 106 is fitted or otherwise applied about an upper end portion of the elongated shaft 104 in a well-known conventional manner. The handgrip 106 is provided over the upper end portion of the elongated shaft 104 for gripping by a player's hand in order to stroke the putter 100 to putt a golf ball. A lower end portion 104*a* of the elongated shaft 104 may be provided at a shallow obtuse angular relationship to the remainder of the otherwise straight elongated shaft 104.

In accordance with the present invention, the putter 100 also includes an axle 108 having a substantially straight and cylindrical configuration and a pair of opposite inner and outer ends 108*a*, 108*b*. At the inner end 108*a* the axle 108 is fixedly attached to, and extends outwardly in substantially perpendicular relationship from, the lower end portion 104*a* of the elongated shaft 104. As best shown in FIG. 4, the lower end portion 104*a* of the elongated shaft 104 is provided at the shallow obtuse angular relationship with the remainder of the elongated shaft 104 so that when the lower end portion 104*a* of the elongated shaft 104 is substantially perpendicular to a putting surface S and the axle 108 is then substantially parallel to the putting surface, the elongated shaft 104 will be held by the player at a desired angle θ relative to its lower end portion 104*a* of the elongated shaft 104.

Referring now to FIGS. 1-4, the roller putting head 102 has a roller body 110, a pair of end discs 112, 114, a striking face 116, and a pommel (or rounded knob) 118. The roller body 110 of the roller putting head 102 has a cylindrical configuration, and is made of a yieldably deformable material, such as rubber or a material generally equivalent thereto, that is sufficiently resilient that once deformed the roller body 110 will return to its original cylindrical shape. The roller body 110 has a pair of opposite ends 110*a*, 110*b* and is solid except for a central bore 120 of a cylindrical configuration that is formed in and extends through the roller body from one to the other of its opposite ends. The central bore 120 is so provided to facilitate mounting the roller body 110 over the axle 108 such that the roller putter head 102 can undergo rotation about and relative to the axle 108.

The end discs 112, 114 of the roller putting head 102 are made of a suitably rigid material, such as a suitable metal or plastic, and disposed and adhered to the opposite ends 110*a*, 110*b* of the roller body 110. The end discs 112, 114, so positioned, assist in maintenance of the dimensional integrity and rollability of the roller body 110 on the axle 108. The end discs 112, 114 have respective central apertures 112*a*, 114*a* the same diameter size as, and which align with, the central bore 120 of the roller body 110 so that the axle 108 will align with and extend through the central bore 120 of the roller body 110 and apertures 112*a*, 114*a* of the end discs 112, 114.

The striking face 116 of the roller putting head 102 is formed by an annular bed of multiple flexible projections 122 defined on and about the roller body 110. The projections 122 may take the form of spike-shaped formations being equally spaced apart from one another and made of the same material as the roller body 110 so that the projections of the striking face 116 are relatively "soft" and deflectable, and thus yieldably conformable to the shape of the golf ball upon impacting the golf ball. As opposed to the striking surface, or face, of a prior art putting head being harder than the surface of the golf ball such that the surface of the golf ball yieldably conforms to the striking surface of the head at the impact therewith, the projections 122 of the striking face 116 on the roller body 110 being at least softer than the surface of the golf ball will yieldably conform to the surface of the golf ball at the impact therewith. The projections 122 forming the striking face 116 protrude from the roller body 110 over a uniform distance and radially outward from a central axis A of the roller body.

The pommel 118 of the roller putting head 102 fits on the outer end 108*b* of the axle 108. The outer end 108*b* of the axle 108 may be threaded so that the pommel 118 by having internal threads (not shown) may be screwed onto the outer end 108*b* of the axle 108. The pommel 118 is configured so as to enable the player to adjust the rolling mechanism or rollability of the roller body 110 on the axle 108 so that the player will be able to hit the golf ball with an impact that will result in the golf ball rolling towards the hole on the green.

The above-described roller putter head of the present invention provides numerous advantages and benefits to a player's short game. By using a putter mounting the roller putting head, the player can potentially perform a near perfect rolling of the golf ball thus avoiding the errors which result by a hard surface impact. With the roller putting head the angle of impact will not have a major effect on the path of the golf ball to the hole. The roller putting head eliminates the presence of the rear mass located rearwardly of the putting face, as used on the prior art putting heads, and thereby eliminates putting head drag back and through the putting stroke as well as overcomes the inability to roll the golf ball without error due to impacting a hard surface at the moment of inertia. In comparison to hard surface impacts, the soft impacts of the roller putting head with the golf ball provides enhanced stability and forgiveness especially on off-center hits and promotes easier path control when curved paths are envisioned. Additionally, the roller putting head provides more optimum head feel at current standard playing lengths (32-35 inches), makes it easier for the player to envision and focus the golf ball in the putting cup, and eliminates excessive wrist flexures. Finally, the roller putting head can be built into any putter design already in use.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A golf club putting head, comprising:

a roller body of a cylindrical configuration; and a striking face defined on and about said roller body being yieldably conformable to the shape of a golf ball upon impacting the golf ball, wherein said striking face is formed by an annular bed of multiple flexible projections formed on and about said roller body.

2. The putting head of claim 1 wherein said roller body has a pair of opposite ends and a central bore extending through said roller body from one to the other of said opposite ends thereof and being configured to mount said roller body over an axle on a lower end portion of a golf club putter shaft such that said roller body can undergo rotation about and relative to the axle.

3. The putting head of claim 2 further comprising a pair of end discs made of a rigid material, having central apertures and being respectively adhered to said opposite ends of said roller body.

4. The putting head of claim 2 further comprising a pommel for adjusting the rollabiltiy of said roller body on the axle so as to enable a player to hit the golf ball with an impact that will result in the golf ball rolling towards a hole.

5. The putting head of claim 1 wherein said central bore is of a cylindrical configuration.

6. The putting head of claim 1 wherein said projections protrude radially outward from said roller body over a uniform distance.

7. The putting head of claim 1 wherein said projections are spike-shaped formations equally spaced apart from one another on and about said roller body.

8. The putting head of claim 1 wherein said roller body has a central axis and said projections protrude radially outward from said central axis.

9. The putting head of claim 1 wherein said roller body and projections thereon are made of a yieldably flexible material.

10. A golf club putting head, comprising:

a roller body of a cylindrical configuration, said roller body having a pair of opposite ends and a central bore of a cylindrical configuration formed in and extending through said roller body from one to the other of said opposite ends thereof and being adapted to mount said roller body over an axle on a lower end portion of a golf club putter shaft such that said roller body can undergo rotation about and relative to the axle;

a striking face defined on and about said roller body and being yieldably conformable to the shape of a golf ball upon impacting the golf ball, said striking face being formed by an annular bed of multiple flexible projections formed on and about said roller body; and a pommel fittable on an outer end of the putter shaft axle and being configured for adjusting the rollability of said roller body on the axle so as to enable a player to hit the golf ball with an impact that will result in the golf ball rolling towards a hole.

11. The putting head of claim 10 wherein said projections protrude radially outward from said roller body over a uniform distance.

12. The putting head of claim 10 wherein said projections are spike-shaped formations equally spaced apart from one another on and about said roller body.

13. The putting head of claim 10 wherein said roller body has a central axis and said projections protrude radially outward from said central axis.

14. The putting head of claim 10 wherein said roller body and projections thereon are made of a yieldable flexible material.

15. The putting head of claim 10 further comprising a pair of end discs made of a rigid material, having central apertures and being respectively adhered to said opposite ends of said roller body so as to be disposed over the axle when said roller body is mounted over the axle.

16. A golf club putter, comprising:

an elongated shaft having opposite upper and lower end portions;

a handgrip fitting about said upper end portion of said elongated shaft for gripping by a player's hand in order to stroke the putter to putt a golf ball;

an axle having a pair of opposite ends, said axle at one of said ends being attached to and extending outwardly from said lower end portion of said elongated shaft; and a putting head comprising a roller body of a cylindrical configuration, said roller body having a pair of opposite ends and a central bore of a cylindrical configuration formed in and extending through said roller body from one to the other of said opposite ends thereof and mounting said roller body over said axle such that said roller body can undergo rotation about and relative to said axle;

a striking face defined on and about said roller body being yieldably conformable to the shape of the golf ball upon impacting the golf ball, wherein said striking face of said putting head is formed by an annular bed of multiple flexible projections equally spaced from one another and formed on and about said roller body; and a pommel fitted on an outer end of said axle of said elongated shaft and being configured for adjusting the rollability of said roller body on said axle so as to enable the player to hit the golf ball with an impact that will result in the golf ball rolling towards a hole.

17. The putter of claim 16 wherein said roller body has a central axis and said projections protrude radially outward from said central axis over a uniform distance.

18. The putter of claim 16 further comprising a pair of end discs made of a rigid material, having central apertures, being respectively adhered to said opposite ends of said roller body and disposed over said axle with said roller body being mounted over said axle.

* * * * *